US006171087B1

(12) United States Patent
Iwasa et al.

(10) Patent No.: US 6,171,087 B1
(45) Date of Patent: Jan. 9, 2001

(54) COMPRESSOR AND ITS ASSEMBLING METHOD

(75) Inventors: Makoto Iwasa; Nobuaki Ogawa, both of Shiga; Mitsunori Inaba, Hiroshima, all of (JP)

(73) Assignee: Matsushita Electric Industrial Co., Ltd., Osaka (JP)

( * ) Notice: Under 35 U.S.C. 154(b), the term of this patent shall be extended for 0 days.

(21) Appl. No.: 09/342,011

(22) Filed: Jun. 28, 1999

(30) Foreign Application Priority Data

Oct. 5, 1998 (JP) ..... 10-282443

(51) Int. Cl.[7] ..... F04C 18/00

(52) U.S. Cl. ..... 418/55.4; 418/149; 92/72; 415/215.1

(58) Field of Search ..... 418/55.4, 149; 99/72; 415/215.1

(56) References Cited

U.S. PATENT DOCUMENTS

| | | | | |
|---|---|---|---|---|
| 1,965,198 | * | 7/1934 | Maccabee | 92/72 |
| 4,722,676 | * | 2/1988 | Sugimoto | 418/55.4 |
| 4,810,176 | * | 3/1989 | Suefuji et al. | 418/55.4 |
| 4,913,635 | * | 4/1990 | Ochiai et al. | 418/55.4 |
| 5,569,028 | | 10/1996 | Yamamura et al. . | |
| 5,597,296 | | 1/1997 | Akazawa et al. . | |
| 5,660,538 | | 8/1997 | Higashiyama et al. . | |
| 6,047,629 | * | 4/2000 | Brunner et al. | 92/72 |

FOREIGN PATENT DOCUMENTS

| | | | | |
|---|---|---|---|---|
| 58085387 | | 5/1983 | (JP) . | |
| 0-053689 | * | 3/1985 | (JP) | 418/55.4 |
| 63-158594 | | 10/1988 | (JP) . | |
| 405240171 | * | 9/1993 | (JP) | 418/55.4 |

OTHER PUBLICATIONS

European Search Report for Intren. Appln. No. 99305304 dated Jan. 13, 2000.

* cited by examiner

*Primary Examiner*—Thomas Denion
*Assistant Examiner*—Theresa Trieu
(74) *Attorney, Agent, or Firm*—Ratner & Prestia

(57) ABSTRACT

A compressor which can be easily assembled and can prevent damage of seal members is presented. Its assembling method includes of (a) a step of feeding a front casing having a first inner circumference, a second inner circumference, an opening, a bottom, and a side wall, compression units having a first fitting portion and a first seal groove, and a rear cover having a second fitting portion and a second seal groove, (b) a step of installing a first seal member in the fist seal groove, (c) a step of installing s second seal member in the second seal groove, (e) a step of installing the fixed scroll on the front casing, while fitting the first fitting portion to the first inner circumference, and (f) a step of installing the rear cover to the front casing so as to cover the opening, while fitting the second fitting portion to the second inner circumference. The first fitting gap between the first fitting portion and the first inner circumference is larger than the second fitting gap of the second fitting portion and the second inner circumference. The steps (e) and (f) are the process of inserting the compression unit and the rear cover mutually coupled and mounting the first seal member and the second seal member into the front casing from the opening.

16 Claims, 5 Drawing Sheets

COMPRESSOR AND ITS ASSEMBLING METHOD

FIELD OF THE INVENTION

The present invention relates to a compressor, and more particularly to a compressor used in an air conditioner or the like, and an assembling method thereof.

BACKGROUND OF THE INVENTION

A conventional scroll compressor comprises, as shown in FIG. 6, a rear casing 32 having an opening at the front side, and a front cover 31 placed in its opening. A movable scroll 34, a fixed scroll 39, and a rotation preventive mechanism 36 are disposed in the rear casing 32. An outer circumference of the fixed scroll 39 contacts with an inner circumference of the rear casing 32. The movable scroll 34 is placed between the front cover 31 and the fixed scroll 39 in order to swivel while contacting with the surface of the fixed scroll 39. The rotation preventive mechanism 36 is placed between the movable scroll 34 and the front cover 31 in order to allow the swivel motion only while preventing rotation of the movable scroll 34. A suction chamber 46 for sucking a refrigerant and a discharge chamber 47 for discharging the refrigerant are mutually partitioned through the fixed scroll 39. A suction port 32*c* for sucking the refrigerant is formed in an outer wall of the rear casing 32 of the suction chamber 46. A discharge port 32*d* for discharging the refrigerant is formed in the outer wall of the rear casing 32 of the discharge chamber 47. A first seal member 41 having an O-ring 41 is placed between the inner circumference 32*a* of the rear casing 32 and the fixed scroll 39. This first seal member 41 seals between the fixed scroll 39 and the rear casing 32. It is thus completely sealed between the suction chamber 46 and discharge chamber 47.

A plurality of mounting bases 32*b* for mounting on a vehicle or other mechanical structure are integrally disposed on the outer wall of the rear casing 32. The front cover 31 has a clutch mounting section 31*c*. A shaft 40 is installed so as to cooperate with the movable scroll 34, and this shaft 40 penetrates through the clutch mounting section 31 c, and has its leading end exposed outside. An electromagnetic clutch 38 is installed outside of the clutch mounting section 31*c*, and is coupled to the shaft 40. The front cover 31 is coupled to the rear casing 32 through a second seal member 45, by using bolt 44 or other bonding member. The second seal member 45 seals between the front cover 31 and rear casing 32, and by this seal member 45, the suction chamber 46 and the outside are completely isolated. Thus, a pressure vessel sealing mutually between the suction pressure and atmospheric pressure was constituted by using the first seal member 41 and second seal member 45.

In such conventional compressor, however, the rear casing cover 32 is manufactured separately from the front cover 31, and the rear casing 32 and front cover 31 are coupled through the second seal member when assembling by using bolt 44 or other coupling member. Further, mounting bases 32*b* are integrally formed in the rear casing 32, and a movable scroll 34 and a shaft 40 linked to the electromagnetic clutch are fitted to the front cover 31. Thus, the member and bases 32*b* for fixing the shaft 40 are mutually fitted to different parts.

Accordingly, when the compressor is mounted on the apparatus, it is required to match accurately the precision of mutual positions of the outer member and bases 32*b* coupled to the shaft 40, and the mounting work was complicated.

SUMMARY OF THE INVENTION

The compressor of the invention comprises:

(a) a front casing having a bottom, an opening, a first inner circumference, and a second inner circumference, (b) a compression unit disposed in the front casing, (d) a rear cover disposed to cover the opening, (e) a first seal member disposed between the compression unit and the first inner circumference, (f) a second seal member disposed between the rear cover and the second inner circumference, (g) a suction chamber surrounded by the compression unit and the bottom, and (h) a discharge chamber surrounded by the compression unit and the rear cover.

The compression unit and the rear cover are mutually coupled, the compression unit has a first fitting portion to be fitted to the first inner circumference and a first seal groove formed in the first fitting portion, the rear cover has a second fitting portion to be fitted to the second inner circumference and a second seal groove formed in the second fitting portion, the second inner circumference is positioned at the side closer to the opening than the first inner circumference, the first seal member is disposed in the first seal groove, the second seal member is disposed in the second seal groove, the fitting gap A between the first fitting portion and first inner circumference is larger than the fitting gap B of the second fitting portion and second inner circumference, and the compression unit and rear cover mounting the first seal member and second seal member can be inserted into the front casing from the opening side.

The assembling method of compressor of the invention comprises:

(a) a step of feeding a front casing having a first inner circumference, a second inner circumference, an opening and a bottom, a compression unit having a first fitting portion and a first seal groove, and a rear cover having a second fitting portion and a second seal groove, (b) a step of installing a first seal member in the fist seal groove, (c) a step of installing s second seal member in the second seal groove, (e) a step of installing a fixed scroll on the front casing, while fitting the first fitting portion to the first inner circumference, and (f) a step of installing the rear cover to the front casing so as to cover the opening, while fitting the second fitting portion to the second inner circumference.

The fitting gap "A" between the first fitting portion and first inner circumference is larger than the fitting gap "B" of the second fitting portion and second inner circumference, and the compression unit and rear cover mutually coupled and mounting the first seal member and second seal member are inserted into the front casing from the opening.

Preferably, when inserting the compression unit and rear cover into the front casing, before the first seal member is fitted to the first inner circumference, the first fitting portion is fitted to the first inner circumference, and before the second seal member is fitted to the second inner circumference, the second fitting portion is fitted to the second inner circumference.

Preferably, it further comprises a crankshaft projecting outside from the bottom.

Preferably, the compression unit has a fixed scroll and a swivel scroll, and the first fitting portion and the first seal groove are formed in the fixed scroll.

Preferably, both the first seal member and the second seal member are positioned so that the first fitting portion may be fitted to the first inner circumference and that the second fitting portion may be fitted to the second inner circumference before the first seal member is fitted to the first inner circumference and the second seal member is fitted to the second inner circumference.

In this constitution, the mutual position of the mounting bases of the compressor and the outer member (the other apparatus) may be precision, and it can be mounted easily and accurately on the outer member or the other apparatus. And further, when assembling the compression unit into the front casting, by preliminarily assembling the rear cover and the compression unit, it is possible to assemble easily into the front casing, in the assembled state of the seal members for sealing between the suction pressure and discharge pressure and sealing between the discharge pressure and atmospheric pressure. Moreover, the seal member (O-ring) is not cut off at the edge of the discharge port, and an easy-to-assemble compressor is obtained.

Moreover, if the compression unit is a scroll compression unit, by preliminarily assembling the fixed scroll and rear cover, it is possible to assemble into the front casing in the state of mounting the seal member. Still more, alignment of the fixed scroll and front casing and positioning in the rotating direction are easy, so that the number of steps of assembling is curtailed.

Preferably, the inner diameter of the front casing fitting to the rear cover is larger than the inner diameter of the front casing fitting to the compression unit. In this constitution, when inserting the compression unit into the front casing, the fitting stroke (fitting depth) of the seal member may be shortened, and the assembling work is easier, and damage of seal member may be further prevented.

Further, when the compressor is mounted on the apparatus, the compressor can be easily installed in the correct position.

BRIEF DESCRIPTION OF THE DRAWINGS

FIG. 2(*b*) is a cross sectional view of a fixed scroll alone shown in FIG. 1.

REFERENCE NUMERALS

Figure 1:
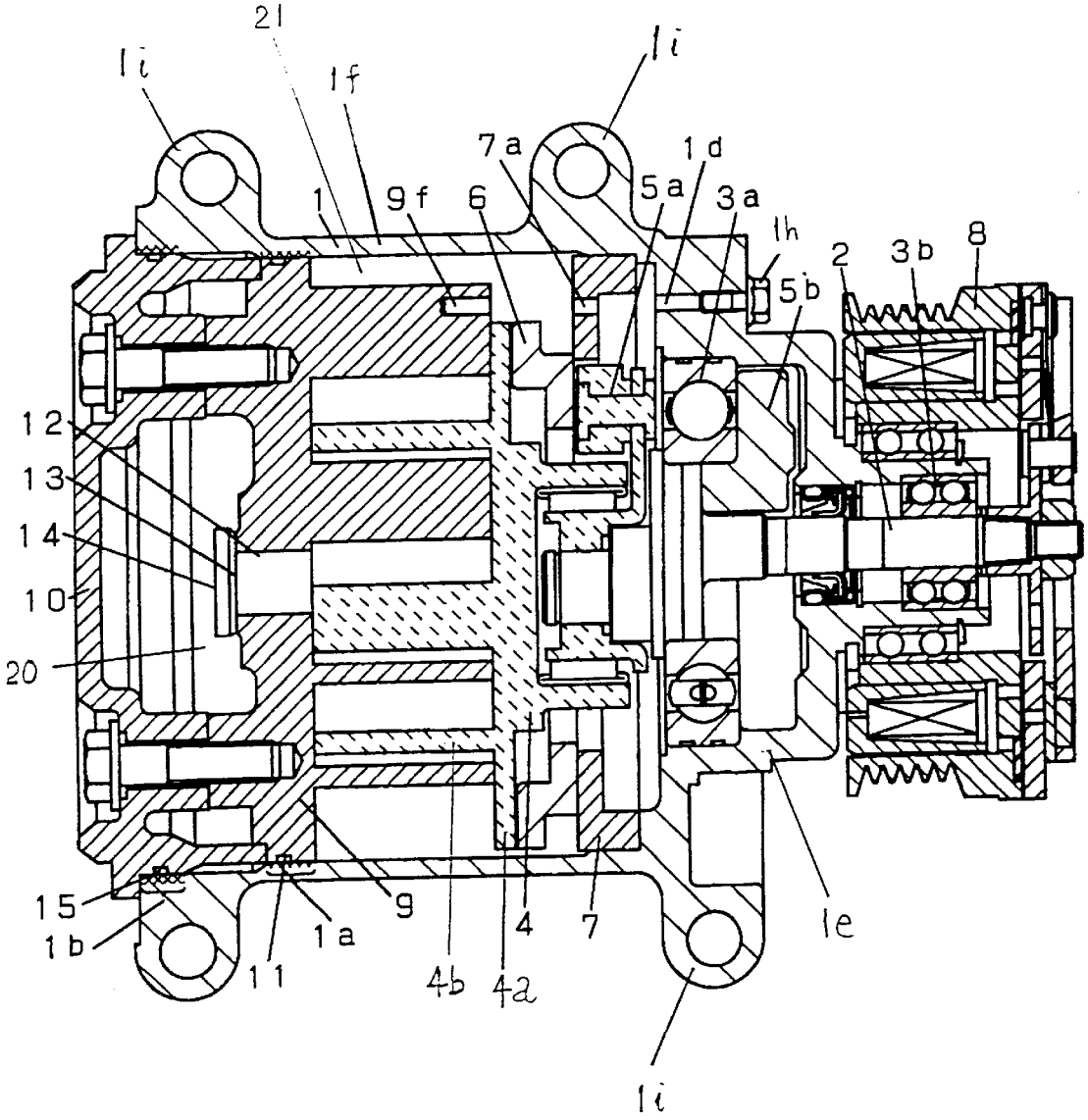
FIG. 1 is a longitudinal sectional view of a scroll compressor in a first embodiment of the invention.

1 Front casing
1*a* First inner circumference
1*b* Second inner circumference
1*c* Discharge port
1*d* Second assembly reference hole
1*e* Bottom
1*f* Side wall
1*h* Bolt
1*i* Base
2 Crankshaft
3*a*, 3*b* Bearing
4 Movable scroll
4*a* Second end plate
4*b* Swivel lap
5*a*, 5*b* Balancer
6 Oldham's ring (rotation preventive mechanism)
7 Slot plate
7*a* Third assembly reference hole
9 Fixed scroll
9*a* First fitting portion
9*b* First end plate
9*c* Fixed lap
9*d* First coupling fitting portion
9*e* First seal portion (first seal groove)
9*f* First assembly reference hole
10 Rear cover
10*a* Second fitting portion
10*b* Second coupling fitting portion
10*c* Second seal portion (second seal groove)
11 First seal member (first O-ring)
15 Second seal member (second O-ring)
20 Discharge chamber
21 Suction chamber

DETAILED DESCRIPTION OF THE INVENTION

The compressor of the invention comprises a cylindrical front casing with a bottom having a bearing disposed in the bottom, a crankshaft supported by the bearing and projecting outside from the bottom of the front casing, a compression unit disposed in the front casing for sucking, compressing and discharging the fluid in cooperation with the rotation of the crankshaft, and a rear cover having a second fitting portion for sealing the front casing while fitting to the inner circumference of the opening side of the front casing in the state coupled with the compression unit.

A first fitting portion to be fitted to the inner circumference of the front casing is formed in the compression unit, and a first seal groove fitting an annular seal member for sealing between discharge pressure and suction pressure of the compression unit is formed in the first fitting portion of the compression unit.

A second seal groove fitting an annular second seal member for sealing between the discharge pressure and atmospheric pressure of the compression unit is formed in the second fitting portion of the rear cover.

A first fitting gap "A" between the first fitting portion of the compression unit and the inner circumference of the front casing is larger than a second fitting gap "B" between the second fitting portion of the rear cover and the inner circumference of the opening side of the front casing, that is, there is a relation of first fitting gap "A">second fitting gap "B".

In the state of the rear cover coupling the compression unit being fitted to the front casing, the first seal member and second seal member are positioned so that the first fitting portion of the compression unit and the second fitting portion of the rear cover may be fitted to each inner circumference of the front casing before the first seal member and the second seal member.

Other compressor of the invention comprises a compressor, a fixed scroll having a fixed scroll end plate and a spiral fixed lap standing upright on this fixed scroll end plate, a swivel scroll having a swivel scroll end plate and a spiral swivel lap sanding upright on this swivel scroll end plate, projecting to the fixed scroll end plate side, and engaged with the fixed lap to form a compression space in a crescent form, a drive mechanism having a swivel member for driving the swivel scroll by a crankshaft, and a rotation preventive mechanism disposed parallel to the swivel scroll end plate, and allowing the fixed scroll to swivel only preventing rotation of the swivel scroll.

The compression unit is composed to suck, compress, and discharge fluid in cooperation with the rotation of the swivel scroll. A first seal portion having an O-ring for sealing between the discharge pressure and atmospheric pressure is formed in a first fitting portion of the rear cover fitted to the inner circumference of the opening side of the front casing. A second seal portion having an O-ring for sealing between the suction pressure and discharge pressure is formed in a second fitting portion of the fixed scroll end plate fitted to the inner circumference of the front casing. Coupling means is disposed for coupling through mutual fitting of fitting portions for coupling provided at the fixed scroll and rear cover.

A first fitting gap "A" between the first fitting portion of the fixed scroll end plate and the inner circumference of the front casing, a second fitting gap "B" between the second fitting portion of the rear cover and the inner circumference of the opening side of the front casing, and a third fitting gap "C" between the fitting portions for coupling of the rear cover and fixed scroll are in a relation of first fitting gap "A">second fitting gap "B" third fitting gap "C".

That is, the second fitting gap "B" between the second fitting portion of the rear cover and the inner circumference of the opening side of the front casing is equal to or larger than the third fitting gap "C" between the fitting portions for coupling of the rear cover and fixed scroll.

In the state of the rear cover coupling the fixed scroll being fitted to the front casing, the first seal portion and second seal portion are positioned so that the first fitting portion of the fixed scroll end plate and the second fitting portion of the rear cover may be fitted to each inner circumference of the front casing before the first seal portion and the second seal portion.

Preferably, the diameter of the inner circumference of the front casing is formed so that the diameter of the second fitting portion of the rear cover may be larger than the diameter of the compression unit or the first fitting portion of the fixed scroll end plate.

An assembling method of compressor of the invention is characterized by assembling preliminarily the rear cover, fixed scroll, first seal portion and second seal portion, and then installing them in the front casing which incorporates the crankshaft, rotation preventive mechanism and swivel scroll.

Other assembling method of the invention comprises the steps of forming assembly reference holes in the fixed scroll and front casing, matching the fitting portion having the second seal portion installed in the rear cover with the opening side inner circumference of the front casing to align the center of the fixed scroll and the center of the front casing, and positioning the fixed scroll in the rotating direction by fitting the pins inserted in the assembly reference holes of the fixed scroll through the front casing.

According to this constitution, by assembling the rear cover and the compression unit preliminarily, the assembly incorporating the first seal member for sealing between the suction pressure and discharge pressure and the second seal member for sealing between the discharge pressure and atmospheric pressure can be easily incorporated into the front casing. Moreover, the first seal member and second seal member are prevented from being damaged or cut by the edge of the discharge hole or the like. Thus, an easy-to-assemble compressor is obtained.

In the constitution in which the compression unit is a scroll compression unit, the rear cover and fixed scroll can be assembled almost concentrically by using the third fitting gap "C".

When the assembly of the first seal portion and second seal portion individually provided with O-rings is incorporated into the front casing, the first fitting portion of the fixed scroll and the second fitting portion of the rear cover are matched before the O-rings of the first seal portion and second seal portion are fitted to the inner circumference of the front casing.

Accordingly, until each O-ring is fitted to the inner circumference of the front casing, there is a degree of freedom between the fixed scroll and rear cover assembled almost concentrically in the rotating direction of the front casing. Therefore, the position of the fixed scroll in the rotating direction can be matched easily.

At the same time, by the second fitting portion "B", the rear cover and front casing can be aligned. Hence, the center of the fixed scroll can be matched with the front casing, which allows to assemble easily the pressure vessel for sealing between the suction pressure and discharge pressure sealed by the O-ring of the second seal portion, and sealing between the discharge pressure and atmospheric pressure sealed by the O-ring of the first seal portion.

When fitting the fixed scroll and rear cover to the front casing, the following relation exists. When the fixed scroll is fitted earlier than the rear cover, the first fitting gap A is the widest. As a result, the degree of freedom in the rotating direction is further increased. Therefore, adjustment in the rotating direction is easier than when the rear cover is fitted earlier than the fixed scroll.

To the contrary, when the rear cover is first fitted to the front casing, the first fitting gap A between the fixed scroll land the front casing serves to correct the fitting deviation between the rear cover and fixed scroll.

Further, both the bottom for holding the crankshaft for coupling a portion to be fixed to an outside device (for example, an electromagnetic clutch) and the base for fixing to the outside device are formed on the same front casing. Accordingly, when fixing the compressor of the invention to an outside device, the compressor can be easily installed at the correct position.

Exemplary embodiments of the invention are described below while referring to the accompanying drawings.

Exemplary Embodiment 1

FIG. 1 is a longitudinal sectional view showing an assembled state of a scroll compressor in a first embodiment of the invention. In FIG. 1, the scroll compressor comprises a cylindrical front casing 1 and a rear cover 10. The front casing 1 has a bottom 1*e,* a side wall 1*f,* an opening, a first inner circumference 1*a,* and a second inner circumference 1*b.* The side wall 1*f* has a base 1*i* for mounting to outside. A crankshaft 2, a movable scroll 4, an Oldham's ring 6, a fixed scroll 9, bearings 3*a*, 3*b*, balancers 5*a*, 5*b*, an Oldham's ring 6, and a slot plate 7 are incorporated in the front casing 1.

The crankshaft 2 is supported by bearings 3*a*, 3*b* disposed in the bottom of the front casing 1. The movable scroll 4 is coupled to the crankshaft 2. The balancers 5*a*, 5*b* serve to cancel the imbalance of the movable scroll 4. The Oldham's ring 6 prevents rotation of the movable scroll 4, and permits only the swivel motion. The slot plate 7 holds the Oldham's ring 6.

A suction chamber 21 is surrounded by the bottom 1*e* and side wall 1*f* of the front casing 1 and the fixed scroll 9. The outer circumference of the fixed scroll 9 and the outer circumference of the rear cover 10 abut against each other, and a space is formed inside of the joined fixed scroll 9 and rear cover 10, in which a discharge chamber 20 is formed. The discharge chamber 20 is surrounded by the fixed scroll 9 and rear cover 10.

The leading end of the crankshaft 2 is exposed outside from the bottom of the front casing 1. An electromagnetic clutch 8 is fitted to the leading end of the crankshaft 2.

When such compressor is installed in an automobile or the like, the rotation of the engine of the automobile is transmitted to the crankshaft 2, and the electromagnetic clutch 8 turns on or off the operation of the compressor as required.

The inner circumference of the front casing 1 has a first inner circumference 1*a* as a fitting portion, and a second inner circumference 1*b* as other fitting portion. The third fitting portion 1*a* is fitted to the fixed scroll 9. The fourth fitting portion 1*b* is formed at the side closer to the opening than the third fitting portion 1*a*. The fourth fitting portion 1*b* is fitted to the rear cover 10.

Figure 2:
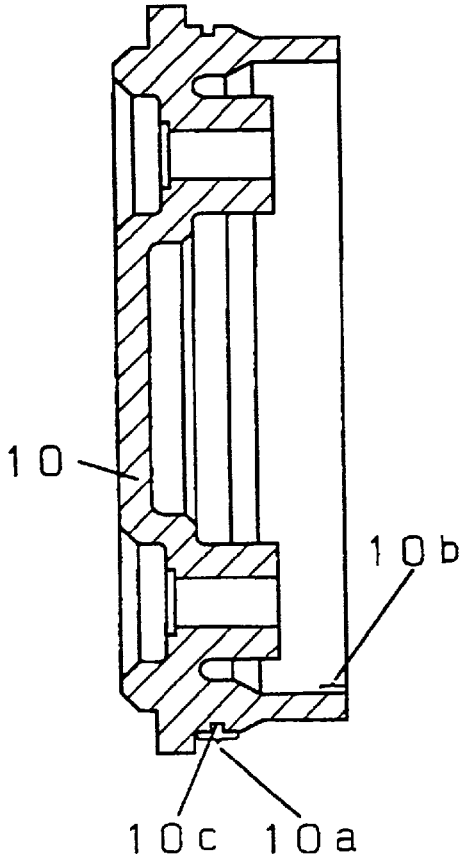
FIG. 2(*a*) is a cross sectional view of a rear cover alone shown in FIG. 1.
Figure 2:
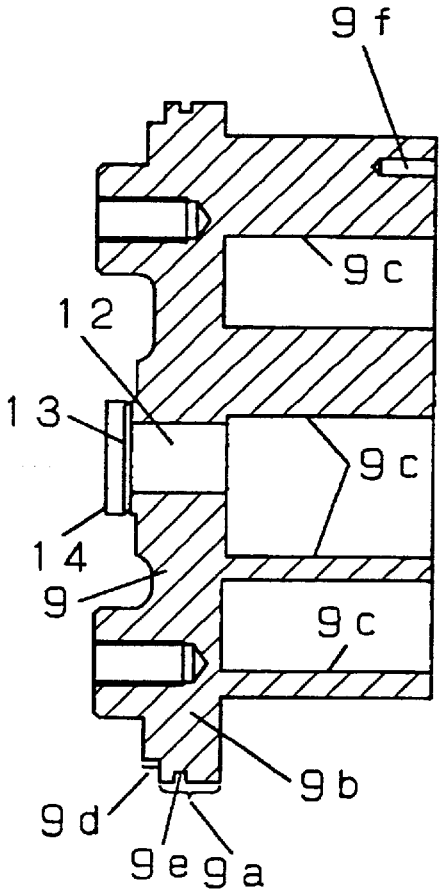

FIG. 2(*b*) is a sectional view of the fixed scroll alone of the embodiment shown in FIG. 1. The fixed scroll 9 has an end plate 9*b* and a fixed lap 9*c*. The end plate 9*b* has an outer circumference forming a first fitting portion 9*a* to be fitted to the first inner circumference 1*a* of the front casing 1. The fixed lap 9*c* is set upright on the end plate 9*b*, and this fixed lap 9*c* has a spiral shape to form a crescent space by engagement with the movable scroll 4.

The movable scroll has a second end plate 4*a* and a swivel lap 4*b* standing upright from the second end plate to the first end plate side. The swivel lap and fixed lap are engaged with each other to form a nearly crescent space. The end plate 9*b* has a first coupling fitting portion 9*d*, and a first seal portion 9*e* disposed on the outer circumference. When the rear cover 10 and fixed scroll 9 are coupled, the first coupling fitting portion 9*d* is concentrically fitted to the rear cover 10.

The first seal portion 9*e* has an annular shape. A first O-ring 11 as a first seal member can be attached to the first seal portion 9*e*. The first O-ring 11 serves to seal between the suction pressure and discharge pressure. The fixed lap 9*c* has a first assembly reference hole 9*f* as the reference of position in the rotating direction when assembling.

A discharge hole 12 is formed nearly in the center of the end plate 9*b*. A discharge valve 13 and a valve retainer 14 are disposed to cover the discharge hole 12, and the discharge valve 13 and valve retainer 14 have function of opening and closing the discharge hole 12.

The refrigerant compressed by the fixed scroll 9 and the movable scroll 4 is discharged into the discharge chamber 20 through the discharge hole 12.

FIG. 2(*a*) is a sectional view of the rear cover alone of the embodiment. The rear cover 10 has a second fitting portion 10*a*, a second coupling fitting portion 10*b*, and a second seal portion 10*c*. The second inner circumference 1*b* formed at the side closer to the opening than the first inner circumference 1*a*. The second fitting portion 10*a* is fitted to the second inner circumference 1*b*. The second coupling fitting portion 10*b* is fitted to the first coupling fitting portion 9*d* when coupling with the fixed scroll 9.

The second seal portion 10*c* has an annular shape. A second O-ring 15 as a second seal member can be attached to the second seal portion 10*c*. The second O-ring 15 serves to seal between the discharge pressure and atmospheric pressure.

A first fitting gap "A" between the first fitting portion 9*a* of the fixed scroll 9 and the inner circumference 1*a* of the front casing 1, a second fitting gap "B" between the second fitting portion 10*a* of the rear cover 10 and the inner circumference 1*b* of the front casing 1, and a third fitting gap "C" between the first coupling fitting portion 9*d* and second coupling fitting portion 10*b* for coupling of the rear cover 10 and fixed scroll 9 are in a relation of first fitting gap "A" >second fitting gap "B" third fitting gap "C".

In addition, a step is formed in the inner circumference of the front casing 1 between the second inner circumference 1*b* and the first inner circumference 1*a*. The second inner circumference 1*b* has a larger diameter than the first inner circumference 1*a* across the step.

As mentioned below, when fitting the coaxially coupled fixed scroll 9 and rear cover 10 into the front casing 1, the first seal portion 9*e* of the fixed scroll 9 and the second seal portion 10*c* of the rear cover 10 are positioned so that the first fitting portion 9*a* of the end plate 9*b* and the second fitting portion 10*a* of the rear cover 10 may be fitted to the first inner circumference 1*a* and second inner circumference 1*b* of the front casing 1 before the firs O-ring 11 and second O-ring 15.

Further, the front casing 1 has a second assembly reference hole 1*d*, and the slot plate 7 has a third assembly reference hole 7*a*, and the second assembly reference hole 1*d* and third assembly reference hole 7*a* are in coaxial or nearly coaxial relation. When adjusting the angle of the fixed scroll 9 in the final step, a pin (not shown) is inserted from the outside of the front casing 1, and the first assembly reference hole 9*f*, second assembly reference hole 1*d*, and third assembly reference hole 7*a* are adjusted to be mutually coaxial. The second assembly reference hole 1*d* is sealed by the bolt 1*h* after assembling.

Figure 3:
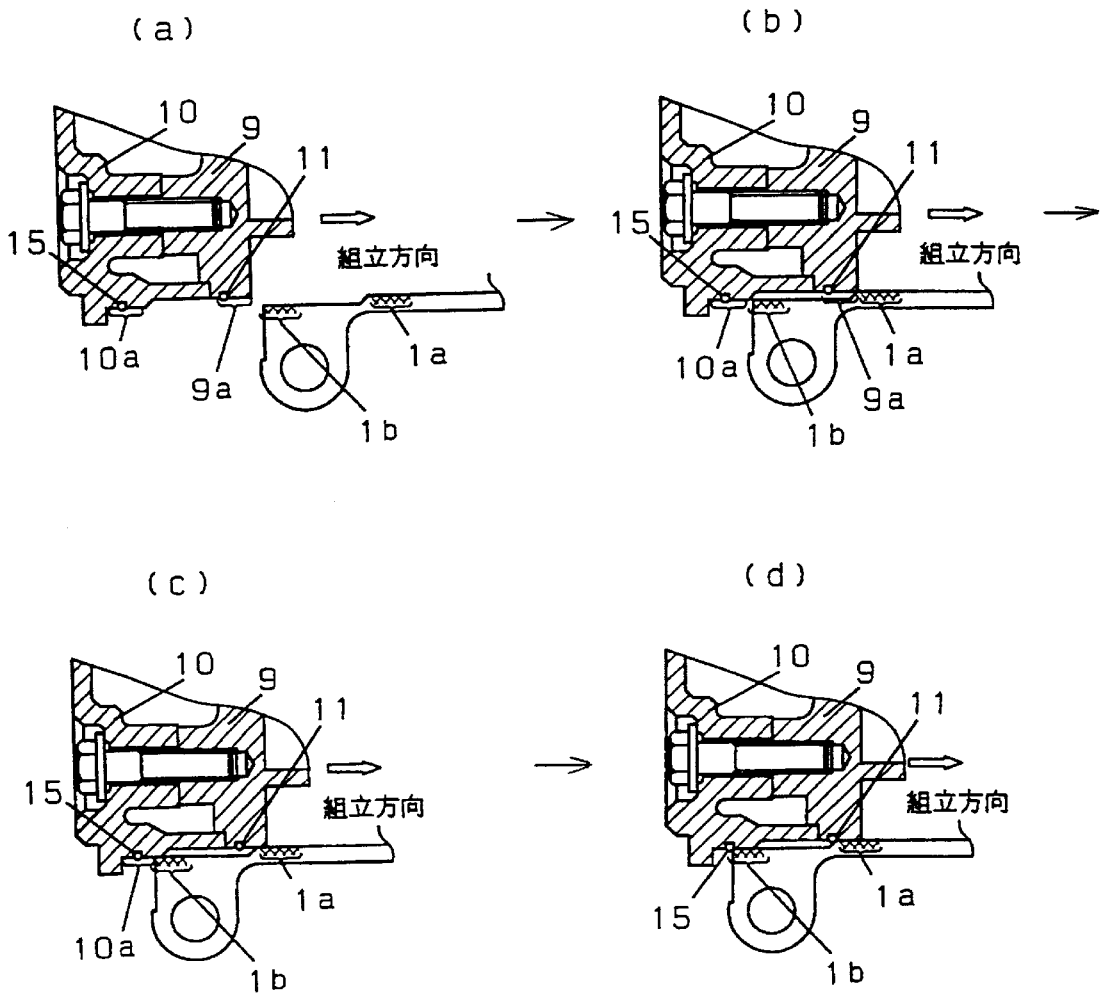
FIG. 3 is an essential sectional view showing a mode of assembling of a coupled assembly of fixed roll and rear cover into a front casing.

In FIG. 3(*a*) to FIG. 3(*d*), the coupled fixed scroll 9 and rear cover 10 are fitted by the first coupling fitting portion 9*d* and second coupling fitting portion 10*b*, and assembled by screw or other coupling means, the first O-ring 11 and second O-ring 15 are fitted into the first seal portion 9*e* and second seal portion 10*c*, respectively, and the fixed scroll 9 and rear cover 10 having these O-rings 11, 15 are assembled into the front casing 1.

That is, FIG. 3(*a*) shows the state before incorporating the assembly of fixed scroll 9 and rear cover 10 into the front casing 1. FIG. 3(*b*) shows the state in which the assembly of fixed scroll 9 and rear cover 10 is gradually inserted into the front casing 1, and the first fitting portion 9*a* of the end plate 9*b* begins to be fitted into the third fitting portion 1*a* of the rear cover 10. FIG. 3(*c*) shows the state in which the fixed scroll 9 and rear cover 10 are further inserted and the second fitting portion 10*a* of the rear cover 10 begins to be fitted into the second inner circumference 1*b* of the front casting 1. FIG. 3(*d*) shows the state in which the first O-ring 11 and second O-ring 15 begin to be fitted respectively into the first inner circumference 1*a* and second inner circumference 1*b*.

In FIG. 3(*a*), the fixed scroll 9 and rear cover 10 are fitted almost concentrically in the narrowest gap between the first coupling fitting portion 9*d* and the second coupling fitting portion 10*b*.

As shown in FIG. 3(*b*), when assembling the fixed scroll 9 and rear cover 10 fitting the first O-ring 11 and second O-ring 15 into the front casing 1, first, the first fitting portion 9*a* and first inner circumference 1*a* are fitted in the widest fitting gap of the fitting gap A. In this state, therefore, the fixed scroll 9 and rear cover 10 have a sufficient degree of freedom in the rotating direction. At this time, by matching the first assembly reference hole 9*f*, second assembly reference hole 1*d* and third assembly reference hole 7*a*, it is easy to position in the rotating direction.

Consequently, as shown in FIG. 3(*c*) and FIG. 3(*d*), the fixed scroll 9 and rear cover 10 are further inserted into the front casing 1, and the second fitting portion 10*a* of the rear cover 10 is fitted into the second inner circumference 1*b* of the front casing 1. At this time, the fitting gap B is smaller than the fitting gap A between the first fitting portion 9*a* of the end plate 9*b* and the third fitting portion 1*a* of the front casing 1. Accordingly, the center of the fixed scroll 9 assembled concentrically with the rear cover 10 can be aligned with the center of the front casing 1. At this time, too, since the first O-ring 11 and second O-ring 15 are not fitted to the front casing 1 yet, it is possible to adjust finely in the rotating direction.

Afterwards, the rear cover 10 and fixed scroll 9 are completely fitted into the front casing 1.

Then the rear cover 10 is completely fitted to the front casing 1 by screw of other fixing means (not shown).

In such compressor, meanwhile, the base 1*i* is fitted to the automobile or other machine, and the electromagnetic clutch 8 is fitted to the functional part of the machine.

Exemplary Embodiment 2

Figure 4:
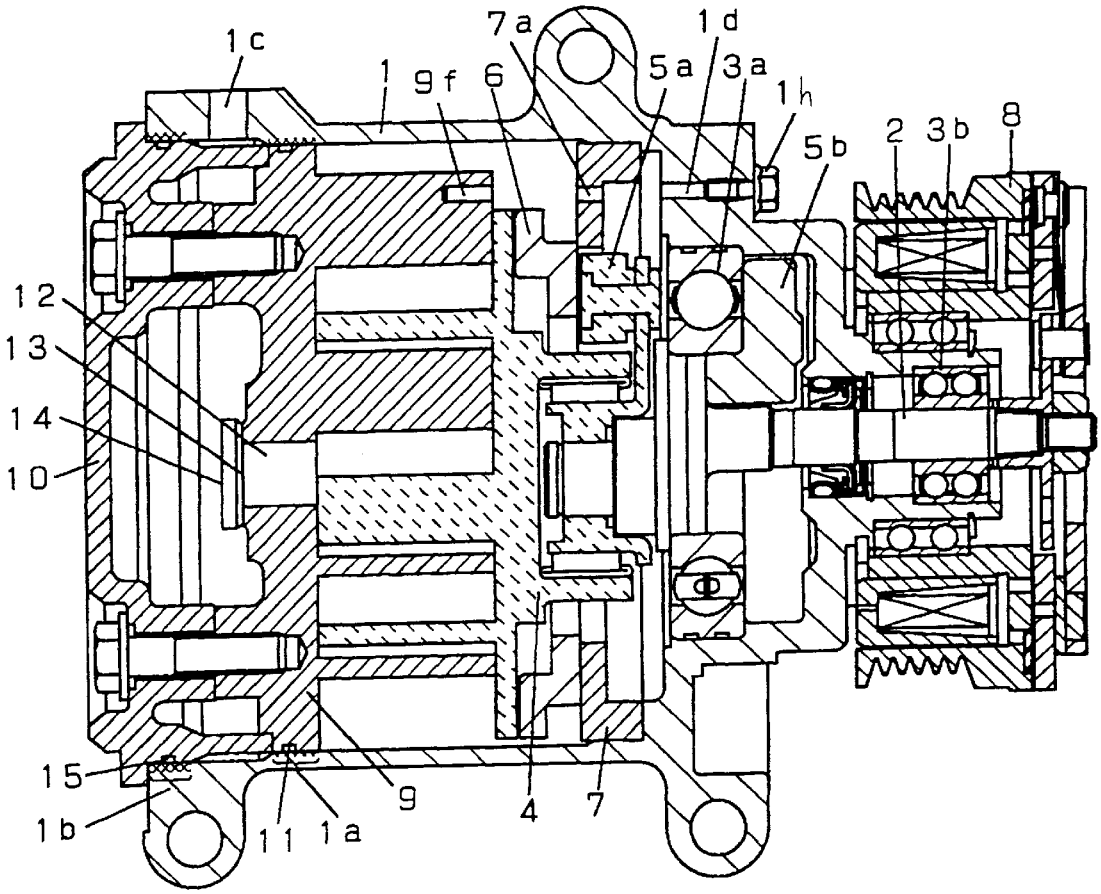
FIG. 4 is a longitudinal sectional view of a scroll compressor in a second embodiment.
Figure 5:
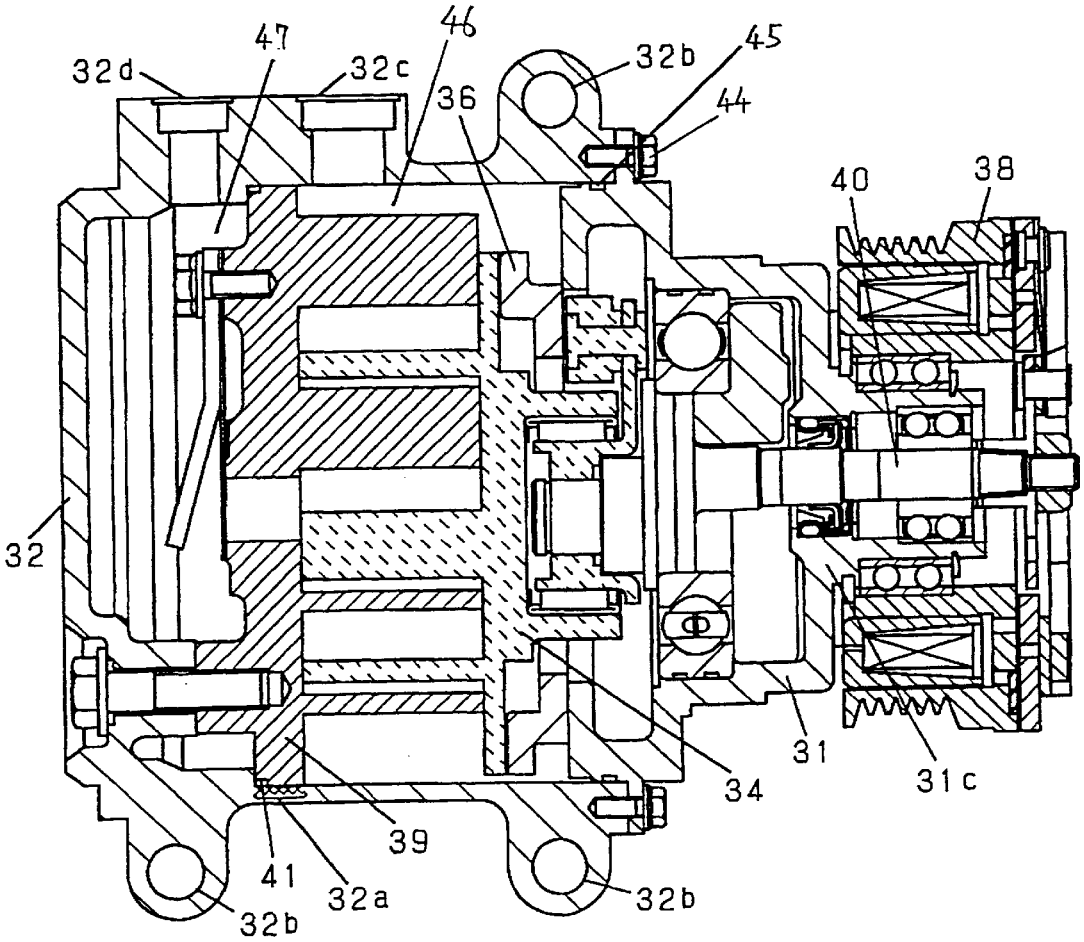
Fig. 5 PRIOR ART
FIG. 5 is a longitudinal sectional view of a conventional scroll compressor.

FIG. 4 is a longitudinal sectional view of a scroll compressor in a second embodiment. In FIG. 4, a discharge hole 1*c* is formed to penetrate through the wall of the front casing 1. The first inner circumference 1*a* formed in the front casing 1 has a smaller diameter than the second inner circumference 1*b*.

When inserting the fixed scroll 9 and rear cover 10 having the first O-ring 11 and second O-ring 15 fitted to the first seal portion 10*c* and second seal portion 9*e* into the front casing 1, the first O-ring 11 is prevented from being caught in the edge of the discharge hole 1*c*, and damage or breakage of the first O-ring 11 is prevented.

In the two forgoing embodiments, the first fitting portion 9*a* of the end plate 9*b* is fitted to the front casing 1 earlier than the fitting portion 10*a* of the rear cover 10, but it is also possible to constitute in the reverse order. In such constitution, too, the same effects as above are obtained.

In the embodiments, the compression unit is the scroll compression unit, but not limited to this, it is also possible to constitute other compression units such as rotary compressor and others. In such constitution, too, the same effects as above are obtained.

As clear from the description herein, the compressor of the invention has the following effects.

The rear cover and compression unit assembling seal members can be easily inserted into the front casing. Damage of seal members by edge of discharge hole can be prevented. As a result, an easy-to-assemble compressor is obtained.

Until each O-ring is fitted to the inner circumference of the front casing, the fixed scroll and rear cover assembled almost concentrically have a degree of freedom in the rotating direction of the front casing. Hence, the position of the fixed scroll in the rotating direction can be adjusted easily.

Moreover, the rear cover and the front casing can be aligned by the fitting gap B, and hence the center of the scroll can be aligned with the front casing.

When assembling the fixed scroll into the front casing, the fitting stroke of seal members may be shortened. Hence, the assembling work is much easier, and damage of seal member may be lessened further.

When mounting the compressor on the machine, the compressor can be easily installed at correct position at high precision.

What is claimed is:

1. A compressor comprising:

(a) a front casing having a bottom, a side wall, an opening, a first inner circumference, and a second inner circumference, (b) compression units disposed in said front casing, (d) a rear cover disposed to cover said opening, (e) a first seal member disposed between said compression unit and said first inner circumference, (f) a second seal member disposed between said rear cover and said second inner circumference, (g) a suction chamber surrounded by said compression unit and said bottom, and (h) a discharge chamber surrounded by said compression unit and said rear cover, wherein said compression unit and said rear cover are mutually coupled, said compression unit has a first fitting portion to be fitted to said first inner circumference and a first seal groove formed in said first fitting portion, said rear cover has a second fitting portion to be fitted to said second inner circumference and a second seal groove formed in said second fitting portion, said second inner circumference is positioned at a side closer to said opening than said first inner circumference, said first seal member is disposed in said first seal groove, said second seal member is disposed in said second seal groove, a fitting gap "A" between said first fitting portion and said first inner circumference is larger than a fitting gap "B" of said second fitting portion and said second inner circumference, and said compression unit and said rear cover mounting said first seal member and said second seal member may be inserted into said front casing from said opening side.

2. A compressor of claim 1, wherein both said first seal member and said second seal member are positioned so that said first fitting portion may be fitted to said first inner circumference and that said second fitting portion may be fitted to said second inner circumference before said first seal member is fitted to said first inner circumference and said second seal member is fitted to said second inner circumference.

3. A compressor of claim 1, further comprising a crankshaft (2) disposed to project from said bottom to outside.

4. A compressor of claim 1, wherein said front casing has a cylindrical shape, and said second inner circumference has a larger diameter than said first inner circumference.

5. A compressor of claim 1, wherein said compression unit has a fixed scroll and a movable scroll, and said first fitting portion and said first seal groove are formed in said fixed scroll.

6. A compressor of claim 1, wherein said compression unit has a fixed scroll and a movable scroll, said first seal member is disposed in said fixed scroll, said fixed scroll has a first coupling fitting portion, said rear cover has a second coupling fitting portion, said first coupling fitting portion and said second coupling fitting portion may be coupled with each other, the second fitting gap "B" between said second fitting portion and said second inner circumference is equal to or larger than the third fitting gap "C" between said first coupling fitting portion and said second coupling fitting portion.

7. A compressor of claim 6, wherein both said first seal member and said second seal member are positioned so that said first fitting portion may be fitted to said first inner circumference and that said second fitting portion may be fitted to said second inner circumference before said first seal member is fitted to said first inner circumference and said second seal member is fitted to said second inner circumference.

8. A compressor of claim 5, wherein said front casing has a cylindrical shape, and said second inner circumference has a larger diameter than said first inner circumference.

9. A compressor of claim 1, wherein said front casing has a discharge hole formed between said first inner circumference and said second inner circumference.

10. An assembling method of compressor comprising the steps of:

(a) feeding a front casing having a first inner circumference, a second inner circumference, an opening, a bottom, and a side wall, compression units having a first fitting portion and a first seal groove, and a rear cover having a second fitting portion and a second seal groove, (b) installing a first seal member in said fist seal groove, (c) installing s second seal member in said second seal groove, (e) installing said fixed scroll on said front casing, while fitting said first fitting portion to said first inner circumference, and (f) installing said rear cover to said front casing so as to cover said opening, while fitting said second fitting portion to said second inner circumference, wherein a first fitting gap between said first fitting portion and said first inner circumference is larger than a second fitting gap of said second fitting portion and said second inner circumference, and said steps (e) and (f) are a process of inserting said compression unit and said rear cover into said front casing from said opening, while said compression unit and said rear cover are mutually coupled and mounting said first seal member and said second seal member.

11. An assembling method of compressor of claim 10, wherein when inserting said compression unit and said rear cover into said front casing, before said first seal member is fitted to said first inner circumference, said first fitting portion is fitted to said first inner circumference, and before said second seal member is fitted to said second inner circumference, said second fitting portion is fitted to said second inner circumference.

12. An assembling method of compressor of claim 10, wherein said compression unit has a fixed scroll and a movable scroll, and said first fitting portion and said first seal groove are formed in said fixed scroll.

13. An assembling method of compressor of claim 10, wherein said compression unit has a fixed scroll and a movable scroll, said first seal member is disposed in said fixed scroll, said fixed scroll has a first coupling fitting portion (9*d*), said rear cover has a second coupling fitting portion, said first coupling fitting portion and said second coupling fitting portion may be coupled with each other, a second fitting gap between said second fitting portion and said second inner circumference is equal to or larger than a third fitting gap between said first coupling fitting portion and said second coupling fitting portion.

14. An assembling method of compressor of claim 12, wherein said front casing has a cylindrical shape, and said second inner circumference has a larger diameter than said first inner circumference.

15. An assembling method of compressor of claim 10, wherein said compressor has a first assembly reference hole, said front casing has a second assembly reference hole, and said steps (e) and (f) are a process of setting a position of said compressor in a rotating direction by matching said second assembly reference hole with said first assembly reference hole, while aligning a center of said fixed scroll and a center of said front casing by fitting said second fitting portion to said second inner circumference.

16. An assembling method of compressor of claim 10, wherein said front casing has a discharge hole formed between said first inner circumference and said second inner circumference.

* * * * *